US007753222B1

(12) United States Patent
Heinrichs

(10) Patent No.: US 7,753,222 B1
(45) **Date of Patent: *Jul. 13, 2010**

(54) CONTAINER, AND RELATED METHODS

(75) Inventor: Mark Anthony Heinrichs, Brielle, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 717 days.

This patent is subject to a terminal disclaimer.

(21) Appl. No.: 11/645,256

(22) Filed: Nov. 20, 2006

Related U.S. Application Data

(63) Continuation of application No. 10/826,791, filed on Apr. 9, 2004, now Pat. No. 7,156,249.

(51) Int. Cl.
*B65D 1/16* (2006.01)
*B65D 6/24* (2006.01)
*B65D 6/26* (2006.01)
*B65D 8/14* (2006.01)

(52) U.S. Cl. ..... 220/4.28; 220/6

(58) Field of Classification Search ..... 220/1.5, 220/4.28, 4.31, 6, 7, 600; 206/386, 600; 232/43.1, 43.2; 312/211, 212
See application file for complete search history.

(56) References Cited

U.S. PATENT DOCUMENTS

| | | | | |
|---|---|---|---|---|
| 3,514,030 | A | 5/1970 | Carroll | 229/23 |
| 3,760,970 | A | 9/1973 | Lutz | 220/4 |
| 3,797,691 | A | 3/1974 | Williams, Jr. | 220/1.5 |
| 3,853,238 | A | 12/1974 | Luisada et al. | 220/1.5 |
| 4,171,058 | A | 10/1979 | Collins | 217/12 |
| 4,186,841 | A | 2/1980 | Buckley et al. | 220/6 |
| 5,056,667 | A | 10/1991 | Coogan | 206/600 |
| 5,597,084 | A | 1/1997 | Parasin | 220/4.28 |
| 6,050,410 | A | 4/2000 | Quirion | 206/386 |
| 6,056,177 | A | 5/2000 | Schneider | 224/401 |
| 6,216,899 | B1 | 4/2001 | Vicari | 220/1.5 |
| 6,415,938 | B1 | 7/2002 | Karpisek | 220/1.5 |
| 6,581,769 | B2 | 6/2003 | Nist | 206/386 |
| 6,598,756 | B1 | 7/2003 | Rosenfeldt | 220/4.28 |
| 6,631,821 | B2 | 10/2003 | Vourganas | 220/1.5 |
| 7,156,249 | B2 * | 1/2007 | Heinrichs | 220/4.28 |

* cited by examiner

*Primary Examiner*—Anthony Stashick
*Assistant Examiner*—Harry A Grosso
(74) *Attorney, Agent, or Firm*—Fredric Zimmerman

(57) ABSTRACT

A container is provided including a support base, side panels having guide tracks, front and rear panels, and a top cover. The front panel includes track followers releasably received in the front guide tracks. The front panel is pivotal outwardly away from the container compartment about the track followers, while the top cover is closed, from a substantially vertical orientation to an angled orientation in which the front panel upper edge is exposed from under the closed top cover. From this angled orientation, and while the cover remains closed, the track followers are slidable along and out of engagement with the respective front guide tracks to detach the front panel from the side panel, thereby providing front access to the container compartment.

21 Claims, 12 Drawing Sheets

CONTAINER, AND RELATED METHODS

The present application is a Continuation Application of prior U.S. patent application Ser. No. 10/826,791 filed on Apr. 9, 2004, now U.S. Pat. No. 7,156,249.

GOVERNMENT LICENSING CLAUSE

The invention described herein may be manufactured and used by or for the Government of the United States of America for governmental purposes without the payment of any royalties thereon or therefore.

BACKGROUND OF THE INVENTION

1. Field of the Invention

The present invention relates to containers generally useful for storage and transportation or goods, especially those loadable and unloadable into ISO (International Organization for Standardization) intermodal containers and flatracks and vehicles such as trucks and cargo bays of planes.

2. Description of Related Art

Containers, especially storage containers, generally take the form of large boxes comprising a base, opposing side walls, opposing end (front and rear) walls, and a cover. These components generally define a container compartment useful for storage and/or transportation of goods. Shipping containers sometimes also are provided with forklift-engageable pallets at their-bases for facilitating loading and unloading of the containers onto vehicles, such as trucks and airplanes.

Containers, such as used for shipping and/or storing, have been used in various industries and settings for the shipment of goods. However, after a container has reached its destination and been unloaded, the empty container often must be returned to its origin or to another destination where the container may be needed for further good storage and transport. The large size and bulk of empty containers can make this return trip expensive and inconvenient. To overcome this problem, a number of containers have been proposed that are convertible from their erect position to a collapsed position that substantially reduces or eliminates the empty compartment space of the container, thereby occupying less space than in the erect position. The reduced size makes transport and storage of the empty containers more economic.

Conventional collapsible containers often have one or more drawbacks. For example, conventional collapsible containers often require extraneous tools and hardware (e.g., screws, adhesive strips, bands) for erect the container. Such tools and hardware are prone to misplacement and damage and sometimes lack reusability. Conventional collapsible containers also often lack components for stable and safe stacking over prolonged storage and transport.

Oftentimes, erect containers are stored or transported under conditions that complicate accessibility to the container compartment and any goods contained therein. For example, containers typically comprise a top cover (or lid) that is removable to permit top access to and loading and unloading of the container compartment. In situations in which erect "modular" containers are stacked one upon another, higher stacked containers may physically block and prevent opening of the lids of lower containers. Access to desired goods in the compartment of the lower containers requires the laborious task of unstacking the higher stacked containers from the desired lower container. Similarly, in other situations in which an erect container is placed into a tight confinement space that prevents opening of the container top, access through the container top may require that the entire container be removed from the confinement space.

SUMMARY OF THE INVENTION

Accordingly, it is an object of the invention to provide a container capable of front panel access without requiring removal or upward movement of the container lid, such that other containers or goods located on top of the container lid need not be removed to gain access to the container compartment.

Another object of the invention to provide a collapsible container capable of front and optionally rear panel access without requiring removal or upward movement of the container lid, such that other containers or goods located on top of the collapsible container lid need not be removed to gain access to the collapsible container compartment.

Another object of the container is to provide a collapsible container that is capable of top, front, rear, or a combination there of to facilitate loading or unloading depending on the equipment being used, i.e. forklift trucks.

Another object of the invention is to provide a collapsible container that does not require any extraneous hardware to erect a container.

Another object of the invention is to provide a container that does not require the use of banding in order to hold the container together.

Another object of the invention is to provide a container that does not require banding in order to lock or hold together like containers, erected or collapsed.

Another object of the invention is to provide a rigid weather resistant collapsible container capable of holding and supporting large loads.

Another object of the invention is to provide a collapsible container that works efficiently with various manners of intermodal transport.

Another object of the invention is to provide a means for the complete inspection of goods in confined spaces, such as required for air transportation of hazardous material.

In accordance with the purposes of the invention as embodied and broadly described in this document, a first aspect of the invention provides a container having a container compartment. The container comprises a support base, first and second side structures respectively comprising first and second side panels respectively having first and second front guide tracks facing one another, a rear panel engaged with the first and second side structures, a front panel comprising a front panel upper edge and first and second front track followers received (optionally releasably) in the first and second front guide tracks, respectively, and a top cover engageable with at least one of the side and rear panels. The top cover optionally is movable between a closed state, in which the cover is positioned over the side panel upper edges and rear and front panel upper edges when the container is in the erect position, and an open state, in which the container compartment is accessible from above. The front panel is pivotal outwardly away from the container compartment about the front track followers, while the front track followers are engaged in the respective front guide tracks and while the top cover is in the closed state, from a substantially vertical orientation to an angled orientation in which the front panel upper edge is exposed from under the closed top cover. From the angled orientation, the front track followers are slidable along the respective front guide tracks, while the cover is in the closed state, to permit front access to the container compartment.

In accordance with the purposes of the invention as embodied and broadly described in this document, a second aspect of the invention provides a collapsible container movable between an erect position and a collapsed position. The container comprises a support base, spaced-apart first and second side structures comprising first and second side panels, respectively, rear and front panels, and a top cover. The first and second side panels each are movable between the erect position, in which the first and second side panels are substantially parallel to one another and substantially orthogonal to the support base, and the collapsed position, in which the first and second side panels are stowed on the support base. The first and second side structures comprise respective front guide tracks facing one another. The rear panel is movable between the erect position, in which the rear panel extends between and is engageable with the first and second side structures, and the collapsed position, in which the rear panel is stowable on the support base. The front panel comprises front track followers releasably received in the front guide tracks of the first and second side structures, respectively. The front panel is movable between the erect position, in which the front panel extends between and is engageable with the first and second side structures, and the collapsed position, in which the front panel is stowable on the support base. The top cover is engageable with at least one of the front, rear, and side panels and is movable between a closed state, in which the cover is positioned over the side panel upper edges and rear and front panel upper edges while the container is in the erect position, and an open state, in which the container compartment is accessible from above. The front panel is pivotal outwardly away from the container compartment about the front track followers, while the front track followers are engaged in the respective front guide tracks, from a substantially vertical orientation to an angled orientation in which the front panel upper edge is exposed from under the cover. From the angled orientation, the front track followers are slidable along and out of engagement with the respective front guide tracks, while the cover is in the closed state, to permit detachment of the front panel for providing front access to the container compartment.

Other aspects of the invention provide methods for attaining front access to a container, and methods for making and using the containers described herein.

BRIEF DESCRIPTION OF THE DRAWINGS

The accompanying drawings are incorporated in and constitute a part of the specification. The drawings, together with the general description given above and the detailed description of the preferred embodiments and methods given below, serve to explain the principles of the invention. In such drawings.

DETAILED DESCRIPTION OF PREFERRED EMBODIMENTS AND METHODS OF THE INVENTION

Figure 1:
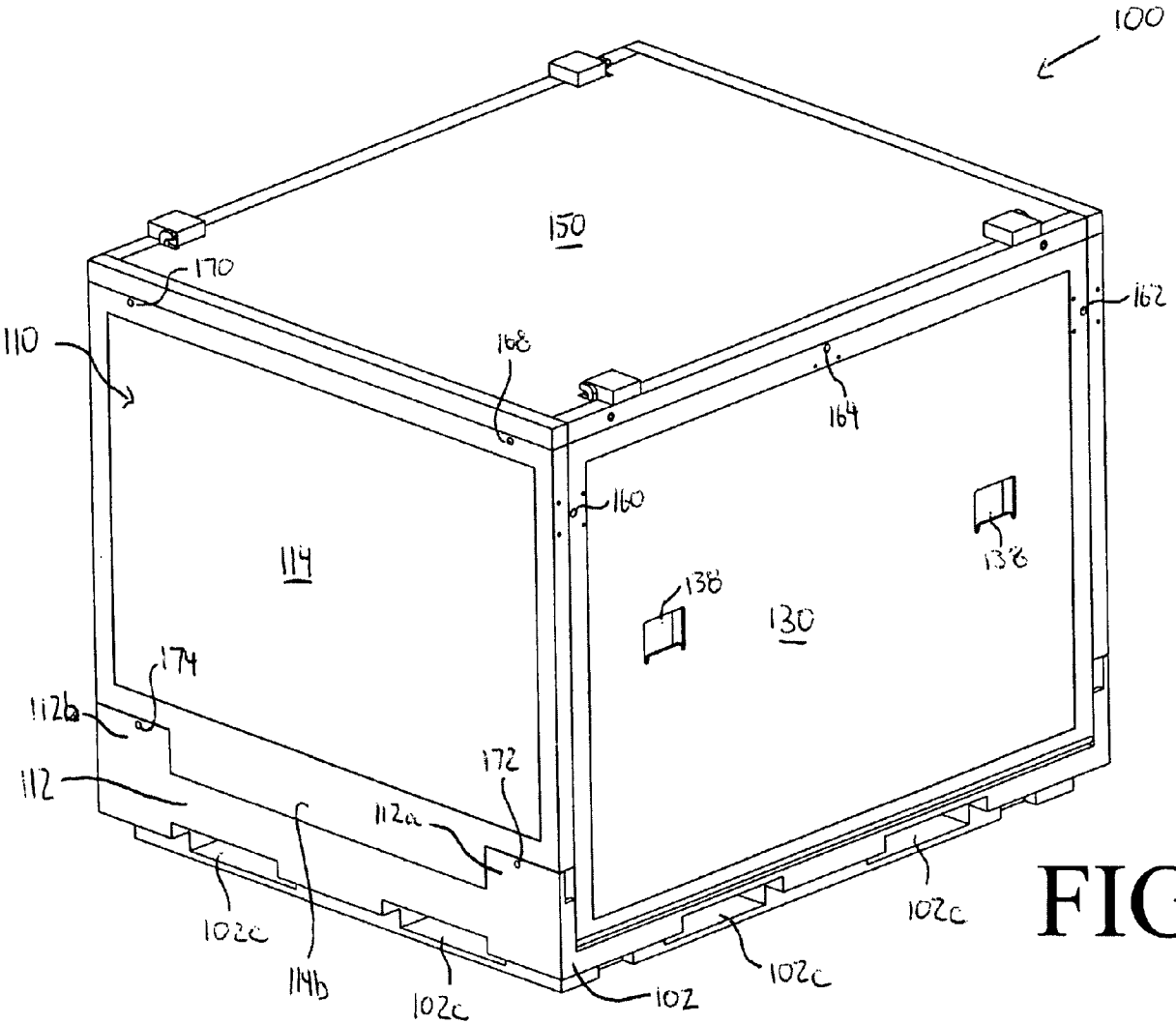
FIG. 1 is a perspective view of a collapsible container according to an embodiment of the invention, the collapsible container depicted in an erect position with the top cover and front panel closed.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

The terms "left," "right," "front," "rear," "horizontal," "vertical," and the like are used herein to assist in and facilitate the description of the invention and its principles and advantages. For the purposes of the detailed description, the reference for each of these terms is the arrangement and orientation of the container as it is depicted in FIG. 1, in which the container base is horizontally oriented and the front panel faces forward. The ability to move and rotate the container into other orientations and positions makes the designations of these terms to the various parts of the container dependent upon view reference. Accordingly, it should be understood that these terms are not to be considered limitations of the invention as the invention is defined in the claims and by equivalents of the claims, unless the context clearly dictates otherwise.

Referring now more particularly to the various figures, there is shown a collapsible container generally designated by reference numeral 100.

Figure 14:
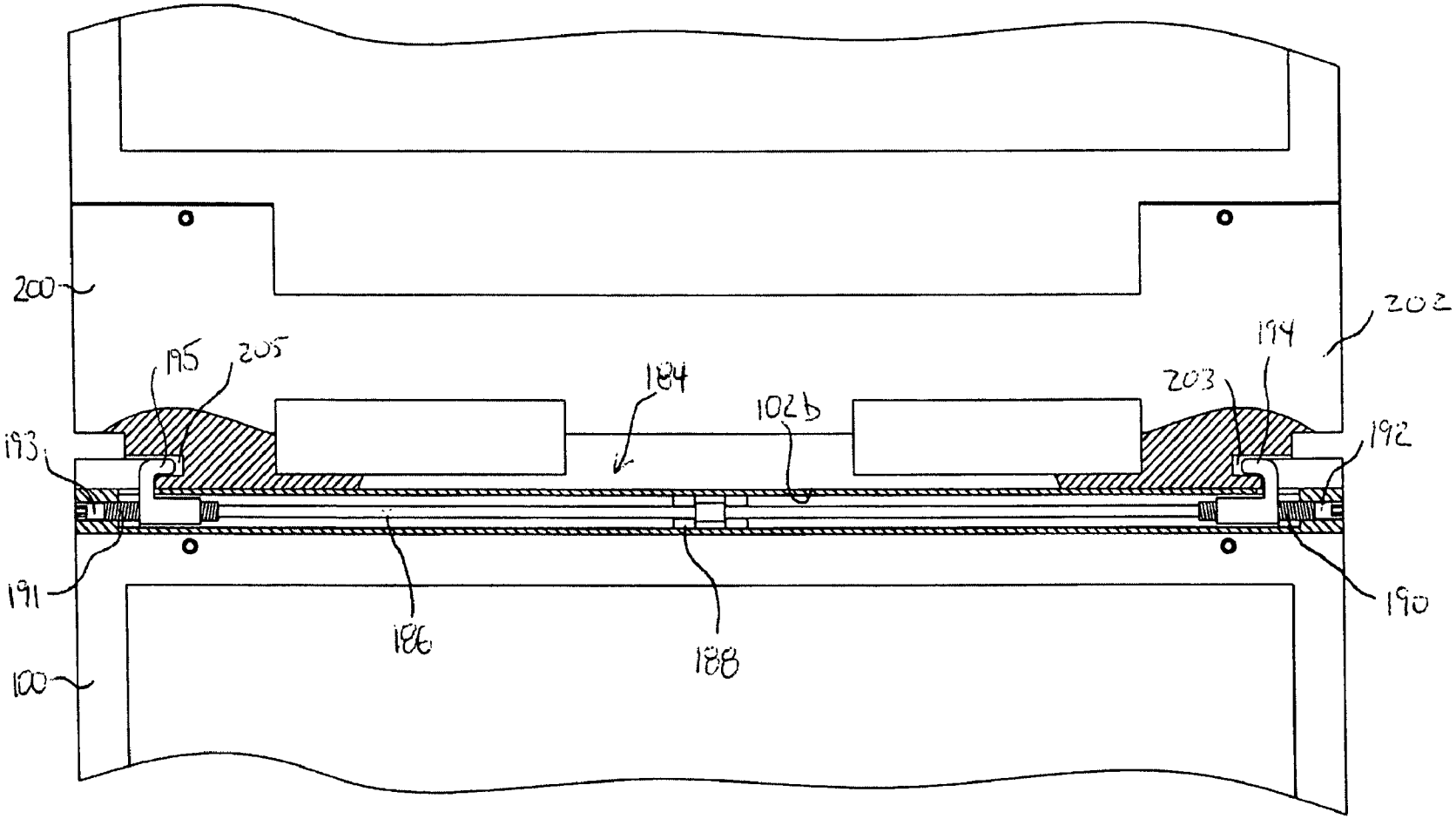
FIG. 14 is a cross-sectional view of the stacked, erect containers of FIG. 12, depicting a locking mechanism for interlocking the containers in stacked arrangement.

The collapsible container comprises a support base. As illustrated, the support base 102 comprises an inner (upward facing) surface or floor 102*a* (FIG. 3) on which goods, shelving, or the like may be placed, and an outer (downward facing) surface 102*b* (FIG. 14). The surfaces 102*a* and 102*b* each are arranged substantially parallel with the platform or floor on which the container 100 rests or is supported. In the illustrated embodiment, the support base 102 is embodied as a multi-way entry pallet, and more particularly a four-way entry pallet. Although the pallet-base is shown in the drawings comprising a four-way forklift entry for receiving a forklift truck from either side or end of the pallet-base, it is also within the scope of the invention to provide a pallet-base having a one-way, two-way, or three-way forklift entry or to omit the pallet and forklift-entry features entirely. The entryways are designated in FIG. 1 by reference numeral 102*c*.

Figure 15:
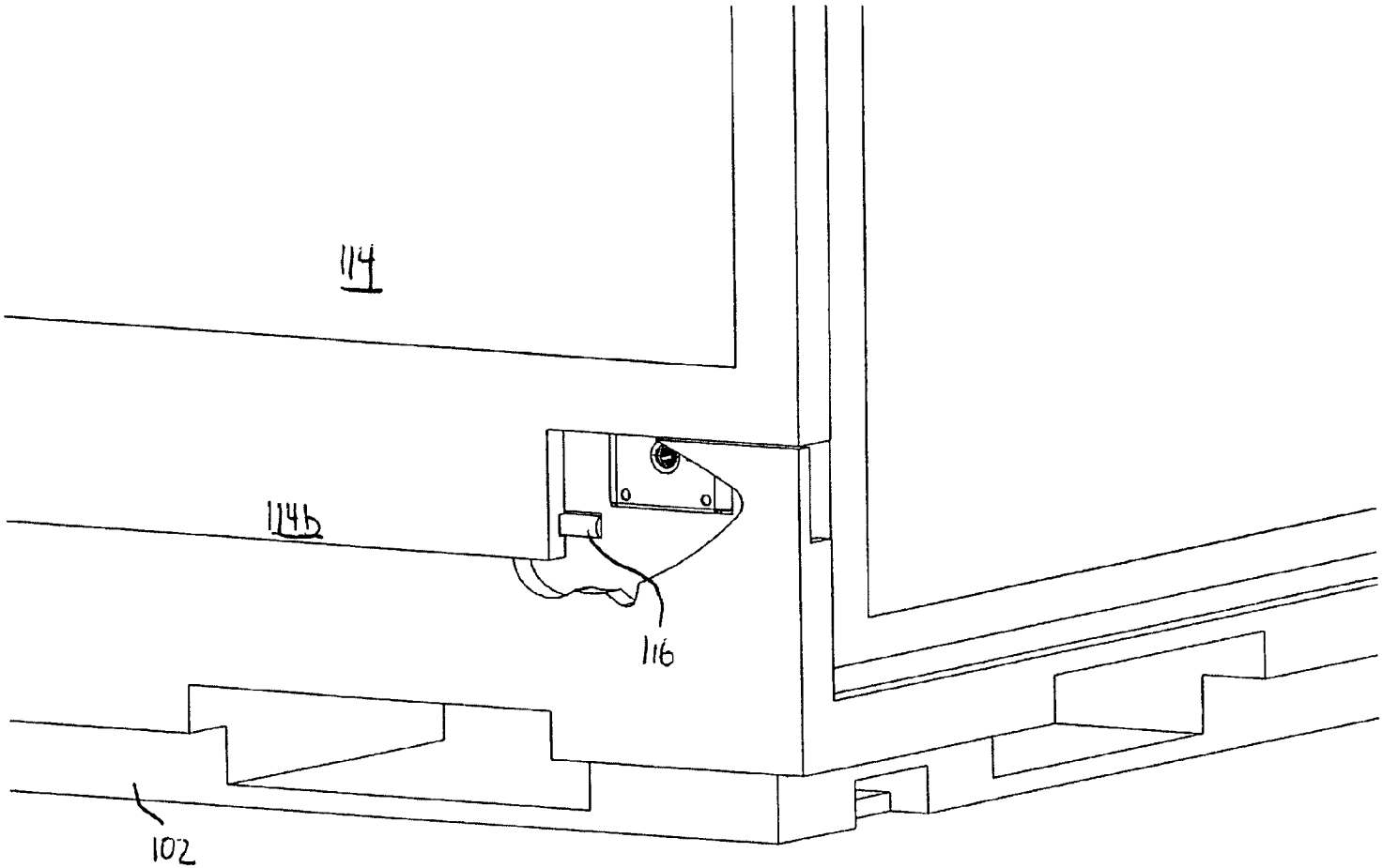
FIG. 15 is a cut-away view of a side panel of the collapsible container.

The collapsible container further comprises first and second side structures comprising first and second side panels, respectively. As illustrated, the first (left, as viewed facing the front of the container 100) side structure 110 comprises first skirt 112 and a first side panel 114. The first skirt 112 is integral with the base support 102, and projects upwardly from a side edge of the base support 102. The first skirt 112 comprises opposing flange portions 112*a* and 112*b*. The first side panel 114 is shown in the erect position supported on the first skirt 112 in FIG. 1. The first side panel 114 comprises an upper edge 114*a* (FIG. 5), and a lower rectangular extension 114*b* received between the flange portions 112*a* and 112*b*. A pivot rod 116 (FIG. 15) pivotally connects the first skirt 112 to the lower rectangular extension 114*b* for moving the first side panel 114 between erect and collapsed positions. In optional embodiments of the invention, the rod 116 may be replaced with hinges, pins, multiple rods or other pivoting or rotating mechanisms.

Figure 5:
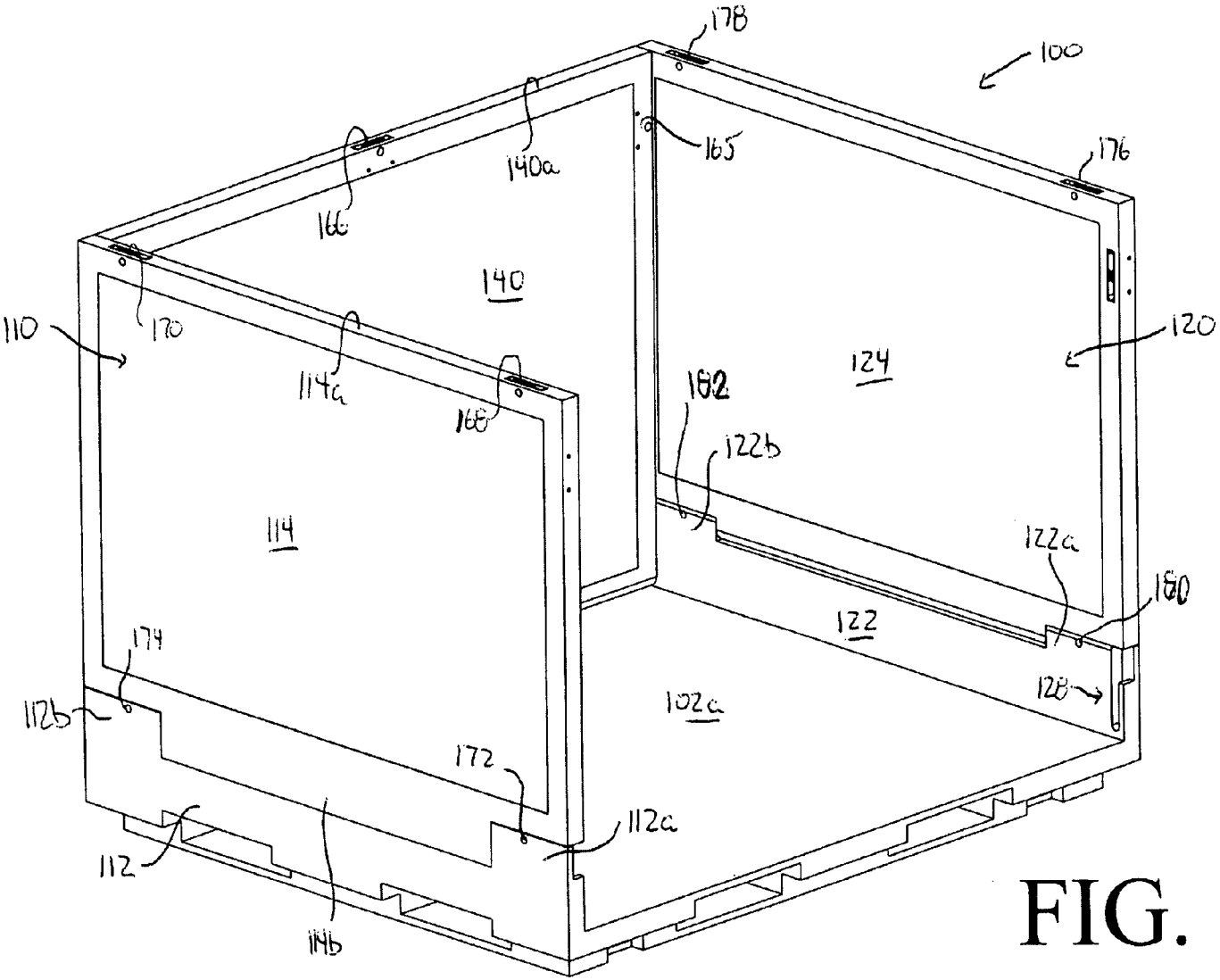
FIG. 5 is a perspective view of the collapsible container of FIGS. 1 through 4 in the erect position, depicting the front and top panels detached and removed from the remainder of the container.

The second side structure 120 (FIG. 5) is spaced apart from the first side structure 110 in the erect position, and comprises a second skirt 122 and a second side panel 124 (both shown in FIG. 5). The second skirt 122 is integral with the base support 102, and comprises flange portions 122*a* and 122*b* (FIG. 5). The second side panel 124 comprises a second upper edge 124*a*, and is pivotally connected to the second skirt 122 via a rod (not shown, but symmetric in position and construction to rod 116). The first and second side structures 110 and 120 are substantial mirror images of one another and, accordingly, mirror image parts of the second side structure 120 will not be described further in the interest of brevity, and vice versa.

Figure 4:
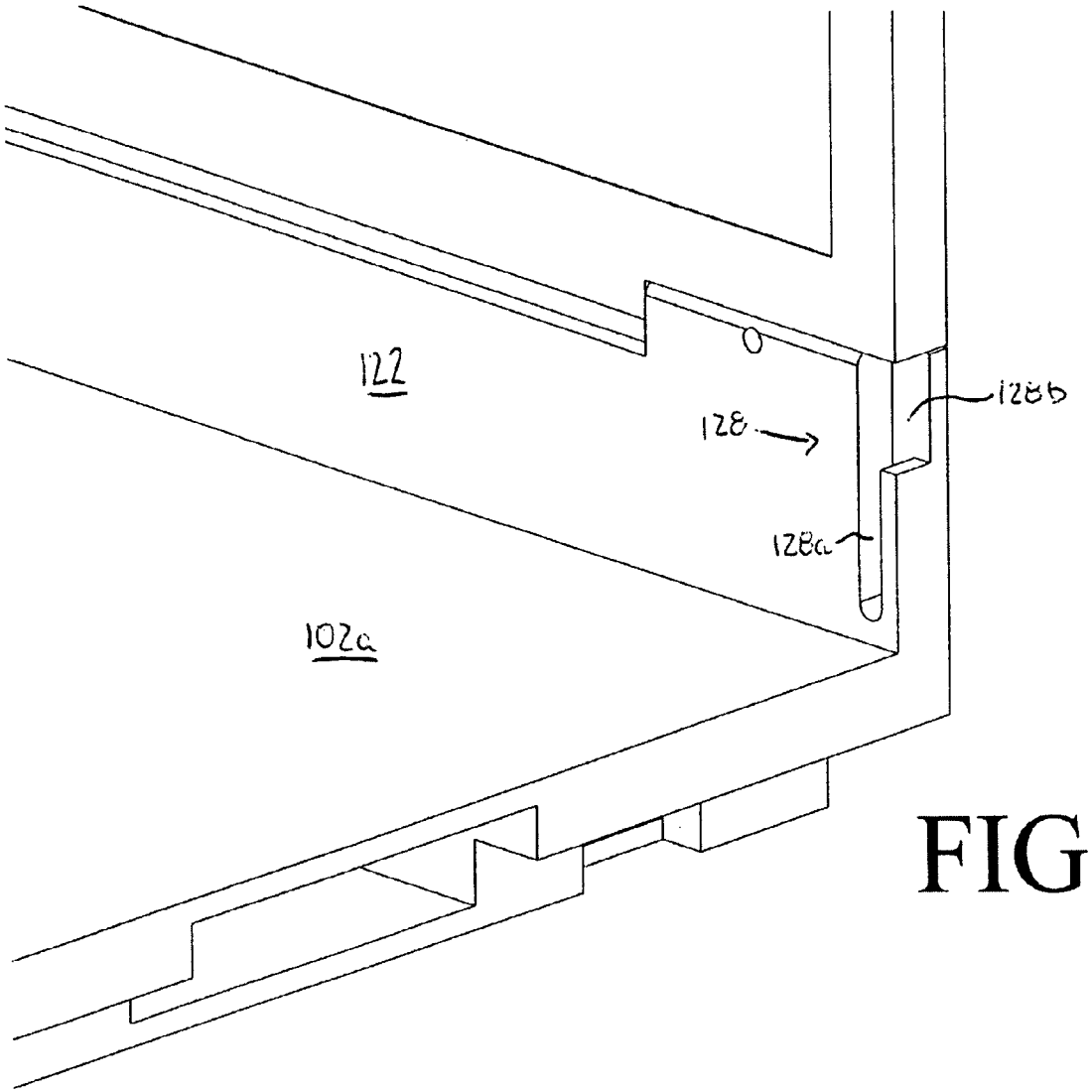
FIG. 4 is an enlarged perspective view of a front guide track of a side panel of the collapsible container of FIGS. 1 through 3.

The first and second side structures comprise respective front guide tracks facing one another. An example of such a front guide track is best shown in FIG. 4, in which the second front guide track associated with the second skirt 122 is designated by reference numeral 128. (The first guide track is not shown, but is associated with the first skirt 112 and opposes and is symmetric to the second guide track 128.) The guide track 128 comprises a substantially vertical channel portion 128*a* and an associated substantially horizontal exposed channel portion (or opening) 128*b* terminating at a front edge of the second skirt 122. Although not shown in the drawings, the first and second side structures 110 and 120 may further comprise first and second rear guide tracks substantially identical to guide track 128, but terminating at the rear edge of the first and second skirts 112 and 122, respectively.

The collapsible container further comprises a front panel and a rear panel movable between the erect position, in which the front and rear panels are substantially vertical and extend between and are engageable with the first and second side structures, and the collapsed position, in which the front and rear panels are stowable on the support base. In the illustrated embodiment, the front panel 130 comprises a front panel upper edge 130*a*, a first (left) front panel side edge 130*b*, and a second (right) front panel side edge 130*c*. Handholds 138 are provided as recesses in the front surface of the front panel 130 for lifting and rotating the front panel 130. In the erect position shown in FIG. 1, the front panel 130 is substantially vertical, extends between the first and second side structures 110 and 120, and rests on the front of the support base 102. First and second front track followers 132 and 134 (FIG. 3) project laterally from the first and second front panel side edges 130*b* and 130*c*, respectively. The front track followers 132 and 134 comprise tracking pins in the illustrated embodiment. Although not shown, the followers 132 and 134 may take different configurations from that of tracking pins, and may take different configurations from one another. The first and second front track followers 132 and 134 are releasably received in the first front guide track and the second front guide track 128, respectively.

As best shown in FIG. 5, the rear panel 140 comprises a rear panel upper edge 140*a*. In the erect position the rear panel 140 is vertical, spaced apart from the front panel 130, and extends between and is engageable with the first and second side structures 110 and 120. In the collapsed position shown in FIG. 7, the rear panel 140 is stowable on the support base 102. The rear panel 140 preferably yet optionally comprises first and second rear track followers (not shown) projecting laterally from the first and second rear panel side edges, respectively. The first and second rear track followers may comprise tracking pins, and are releasably received in the first and second rear guide tracks, respectively.

The container further comprises a top cover or lid, which is designated in the illustrated embodiment by reference numeral 150. The top cover 150 is preferably in the form of a panel. In their erect positions, the top cover 150, base 102, side structures 110 and 120, and front and rear panels 130 and 140 collectively define a container compartment. When the container 100 is erect, the top cover 150 is movable between closed and open states. The closed state is illustrated in FIG. 1, in which the top cover 150 is positioned over and rests on the side panel upper edges 114*a* and 124*a* and rear and front panel upper edges 130*a* and 140*a*. In the closed state, the top cover 150 blocks top access to the container compartment. In the open state, the top cover 150 is removed from contact with one, two, three, or all four of the upper edges 114*a*, 124*a*, 130*a*, and 140*a* to permit top access to the container compartment.

The container further comprises a plurality of mechanisms for latching front, rear, side, and top panels to one another. The front panel 130 is associated with a first latching mechanism 160 for selectively engaging the front panel 130 with the first side panel 114, a second latching mechanism 162 for selectively engaging the front panel 130 with the second side panel 124, and a third latching mechanism 164 for selectively engaging the front panel 130 with the top cover 150. The rear panel 140 is similarly associated with a fourth latching mechanism (not shown, but symmetrical to the first latching mechanism 160) for selectively engaging the rear panel 140 with the first side panel 114, a fifth latching mechanism 165 for selectively engaging the rear panel 140 with the second side panel 124, and a sixth latching mechanism 166 for selectively engaging the rear panel 140 with the top cover 150.

The first side panel 114 is further associated with a seventh latching mechanism 168 and an eighth latching mechanism 170 for selectively engaging the first side panel upper edge 114*a* with the top cover 150. The bottom of the first side panel 114 is associated with a ninth latching mechanism 172 and a tenth latching mechanism 174 for selectively engaging and locking the first side panel 114 in an erect state with the first skirt 112.

Similarly, the second side panel 124 is associated with eleventh and twelfth latching mechanisms 176 and 178 (FIG. 5) for selectively engaging the second side panel upper edge 124*a* with the top cover 150. The bottom of the second side panel 124 is associated with a thirteenth latching mechanism 180 and a fourteen latching mechanism 182 for selectively engaging and locking the second side panel 124 in an erect state with the second skirt 122.

Operation of the latching mechanisms will now be described with reference to FIGS. 8 through 11, which illustrate the first latching mechanism 160. Because the second through fourteenth latching mechanisms are substantially identical to the first latching mechanism 160 in the illustrated embodiment, in the interest of brevity only the first latching mechanism will be described in detail herein.

Referring to FIGS. 8 through 11, the first latching mechanism 160 comprises an interlocking latch unit 250 and receptacle unit 252. The latch unit 250 comprises a housing 254 having an exposed end to define an open compartment. Received within the compartment of the housing 254 is a cam 256. An arcuate retaining ring segment 258 extends along the periphery of the cam 256, and has a greater thickness than the cam 256. Central to the cam 256 is a cam driver 260 having a hex opening 262 accessible from outside the housing 254. The cam driver 260 is operatively attached with the cam 256 to transmit rotational movement to the cam 256. The receptacle unit 252 comprises a housing 264 having an open compartment with an exposed end. Adjacent the exposed end is an arcuate retaining boss 266 fixed to the inner surface of the housing 262. When the front panel 130 is arranged in a vertical and closed position, the open ends of housings 254 and 262 are placed in abutting relationship. A tool, such as a hex key, is inserted into the hex opening 262 of the cam driver 260 and rotated 180 degrees. The front panel 130 is provided with a bore aligned with the hex opening 262. The hex key or other tool is insertable through the bore to allow access to the hex opening 262. Upon activation with the hex key, the cam 256 rotates (see FIG. 10) in unison with the cam driver 260 to position the cam retaining ring 258 about the periphery of the retaining boss 266, thereby latching the units 250 and 252 together.

The latching mechanisms illustrated in FIGS. 8 through 11 are commercially available from Southco. Inc. under the trade designation ROTO LOCK. It is to be understood that the illustrated latching mechanism is a preferred yet optional latching mechanism of the present invention. Other suitable latching and engaging mechanisms may be substituted for one, more, or all of the illustrated latching mechanisms. Further, the container 100 may comprise fewer or more latching mechanisms or differently positioned latching mechanisms than illustrated in the drawings.

Figure 2:
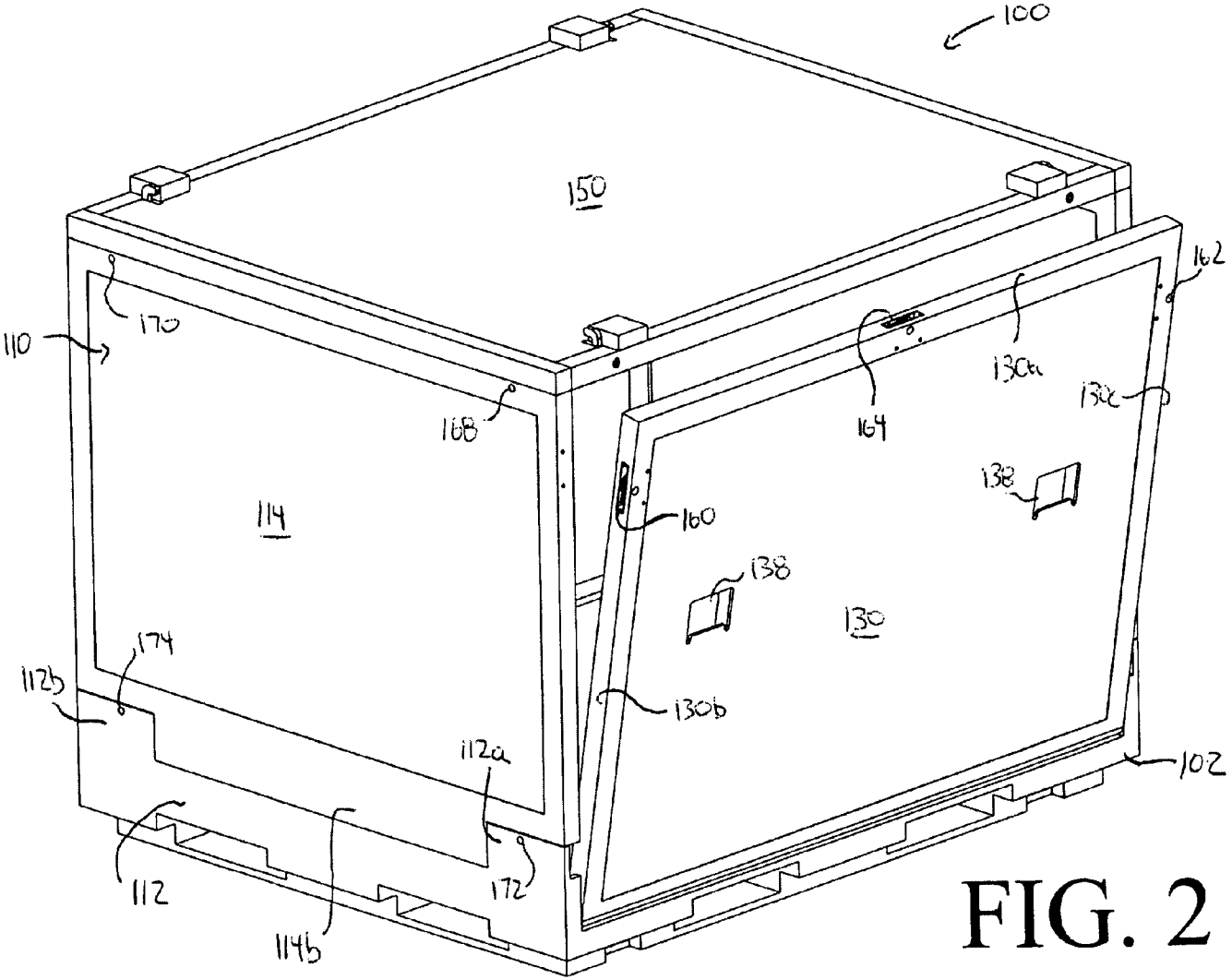
FIG. 2 is a perspective view of the collapsible container of FIG. 1 in the erect position, depicting the front panel partially open at an angled state.
Figure 3:
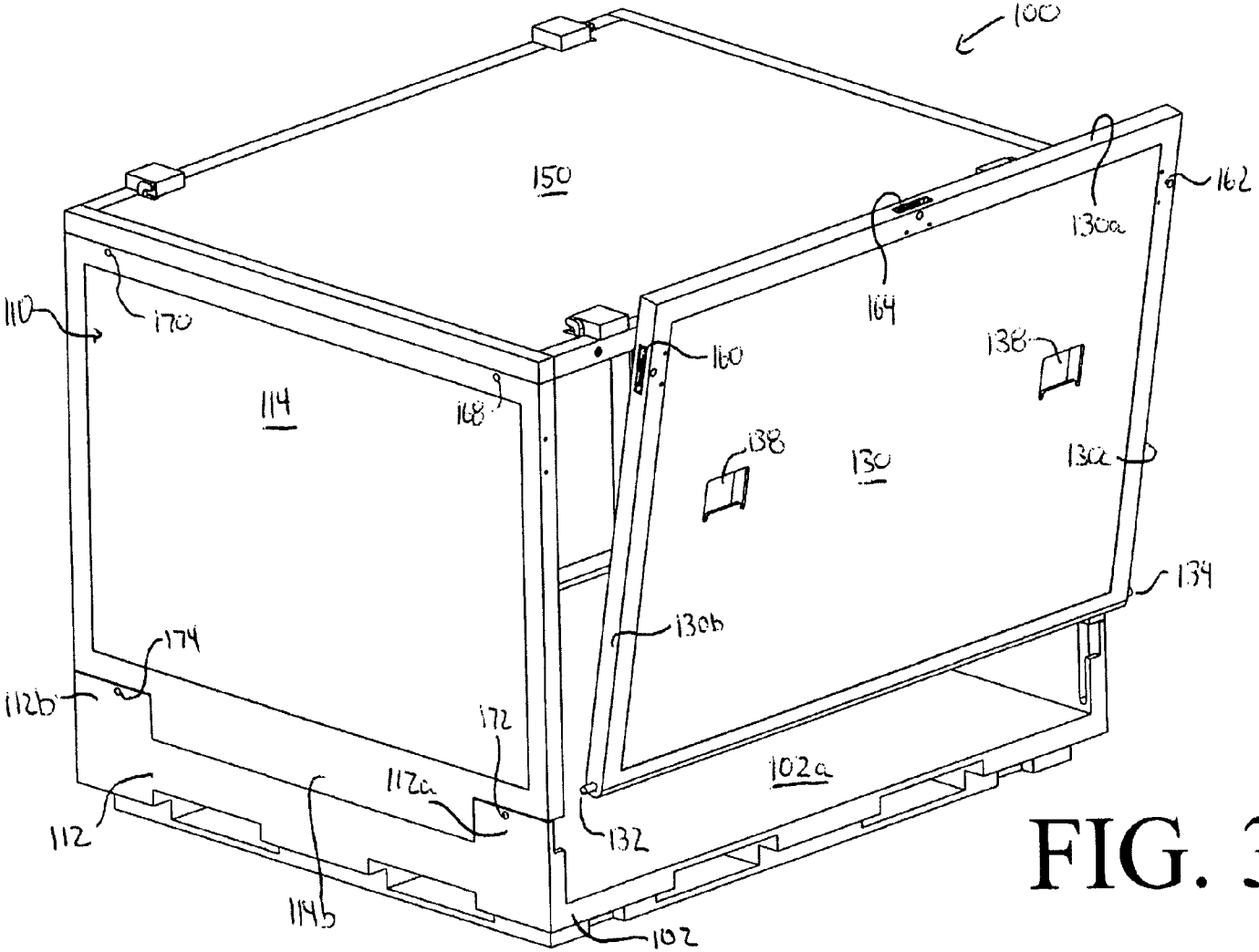
FIG. 3 is a perspective view of the collapsible container of FIGS. 1 and 2 in the erect position, depicting the front panel detached from the remainder of the container.

An embodiment of a method for moving the collapsible container 100 between the erect and collapsed positions will now be explained in detail. Referring to FIGS. 2 and 3, the first, second, and third latching mechanism 160, 162, and 164 are unlatched to selectively disengage the front panel 130 from the first side panel 114, the second side panel 124, and the top cover 150, respectively. In the illustrated embodiment, the top cover 150 in the closed state prevents substantial vertical upward movement of the unlatched front panel 130 from its substantially vertical state. Accordingly, to transfer the unlatched front panel 130 out of the erect position, the front panel 130 is pivoted outwardly away from the container compartment. Pivotal movement occurs about the axes of the first and second front track followers 132 and 134, which are preferably received in the bottom of the substantially vertical channel portions of the guide tracks. The front panel upper edge 130*a* moves along an arcuate path to place the front panel 130 in an angled orientation shown in FIG. 2, thereby exposing the front panel upper edge 130 from under the top cover 150. Although not shown in FIG. 2, the "angled orientation" may encompass other angles from vertical. For example, the front panel 130 may be pivoted to an orthogonal arrangement relative to its erect position. The front panel 130 may be pivoted still further until the upper edge 130*a* rests against the ground, so that the front panel 130 effectively provides a ramp.

From the angled state described above, the front panel 130 is movable upward along a substantially vertical path as the first and second front track followers 132 and 134 slide in unison upward along the substantially vertical channel portions of the guide tracks. When the track followers 132 and 134 reach the top of the substantially vertical channel portions of the guide tracks, the front panel 130 is movable outwardly away from the container compartment, i.e., forwardly. The first and second front track followers 132 and 134 are slidable in unison through the substantially horizontal channel portions of the guide tracks to detach the front panel 130 from the remainder of the container 100. Detachment of the front panel 130 from the remainder of the erect container 100 permits unobstructed front access to the container compartment. Significantly, the front panel 130 of this embodiment is detachable without requiring that the top cover 150 be removed or partially opened. (The above-described capability does not preclude the operator from optionally removing the top cover 150 or separating the top cover 150 from contact with the front panel upper edge 130*a* prior to detachment of the front panel 130.)

The embodiment depicted in the figures show the collapsible container 100 comprising a front panel 130 capable of detachment for providing a front access opening. Other embodiments comprise two or more detachable panels. For example, in a preferred yet optional embodiment of the invention, the rear panel 140 is pivotally movable and detachable in substantially the same manner described above with regard to the front panel 130. An embodiment for detaching the rear panel 140 comprises unlatching the fourth latching mechanism from the first side panel 114, the fifth latching mechanism 165 from the second side panel 124, and the sixth latching mechanism 166 from the top cover 150. The rear panel 140 is then pivotal outwardly away from the container compartment about the rear track followers, while the rear track followers are engaged in the respective rear guide tracks, from a substantially vertical orientation to an angled orientation in which the rear panel upper edge 140*a* is exposed from under the cover 150. From the angled orientation, the rear panel 140 is slidable upwardly and outwardly, optionally while the cover 150 is in the closed state, to slide the rear track followers along and out of engagement with the respective rear guide tracks and to permit removal of the rear panel 140 for providing unobstructed rear access to the container compartment.

Detachment of the top cover 150 to provide top access to the container compartment comprises unlatching the third, sixth, seventh, eighth, eleventh, and twelfth latching mechanisms (164, 166, 168, 170, 176, 178). The top cover 150 may then be detached and removed, as shown in FIG. 5. The top cover 150 may be detached prior or subsequent to removal of the front panel 130 and/or the rear panel 140.

Figure 6:
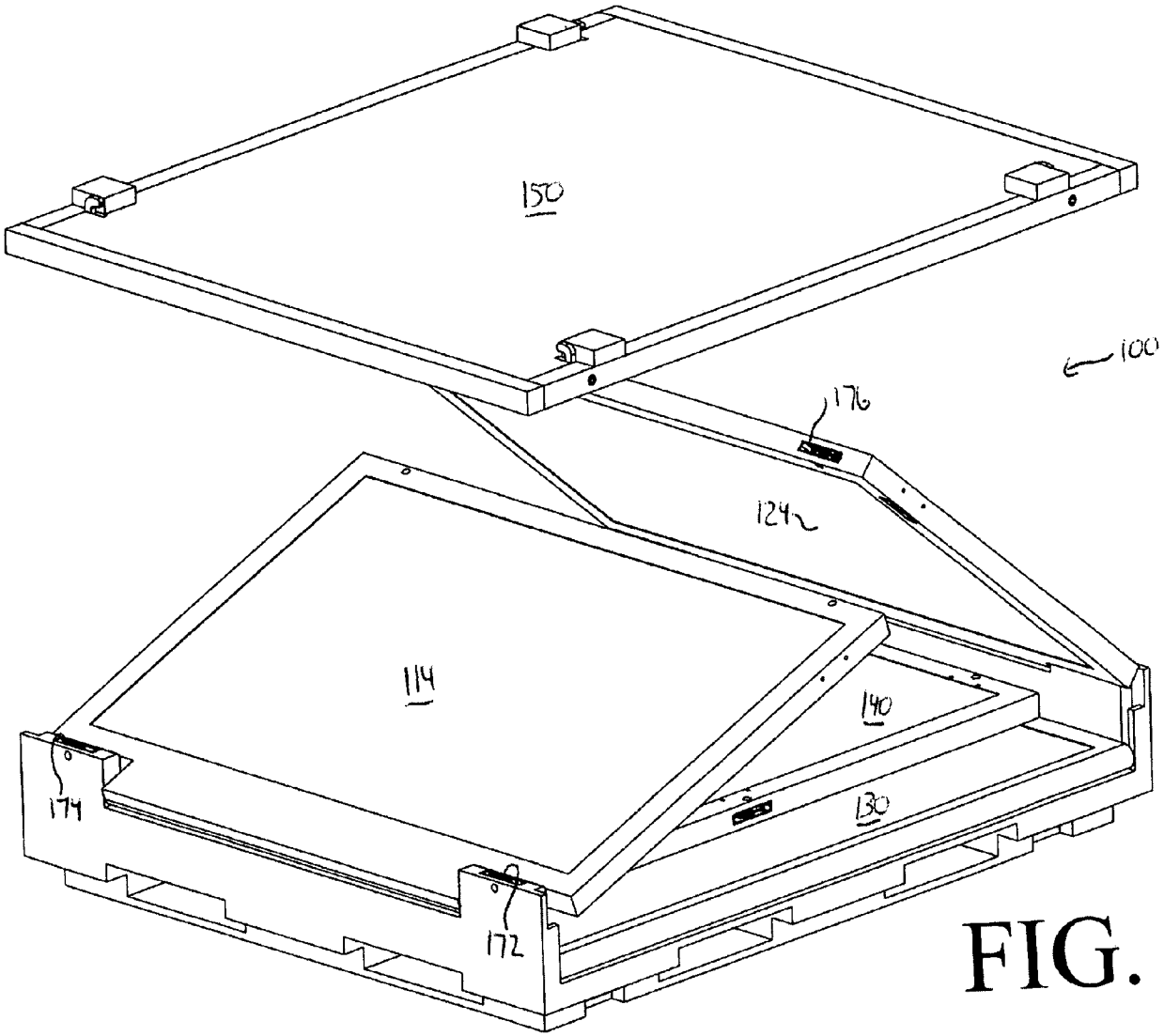
FIG. 6 is a perspective view of the collapsible container of FIGS. 1 through 5 shown in transition from the erect position to a collapsed position.

Referring now more particularly to FIG. 6, the first and second side panels 114 and 124 each are movable from the erect position to the collapsed position. In the erect position, the first and second side panels 114 and 124 are substantially parallel to one another and substantially orthogonal to the support base 102. In the collapsed position, the first and second side panels 114 and 124 rest on the support base 102 and are preferably substantially parallel with the base support 102. Movement of the first side panel 114 into the collapsed position comprises unlatching the ninth latching mechanism 172 and the tenth latching mechanism 174, then pivoting the first side panel 114 about the pivot rod 116. Movement of the second side panel 124 into the collapsed position comprises unlatching the thirteenth latching mechanism 180 and the fourteenth latching mechanism 182, then pivoting the second side panel 124 about its pivot rod.

According to an embodiment of the invention, in the interest of stowability the front and rear panels 130 and 140 are seated or otherwise stowed on the inner surface 102*a* of the support base 102, below the collapsed side panels 114 and 124. Preferably, each of the first and second skirts 112 and 122 has a height equal to or greater than the combined thickness of the front panel 130 and the rear panel 140. This allows the front and rear panels 130 and 140 to be stowed below the collapsed side panels 114 and 124. Also preferably, the respective pivot joint heights of the side panels 114 and 124 are offset vertically from one another to allow the front and rear panels 130 and 140 to lay substantially horizontally on the support base 102.

Figure 7:
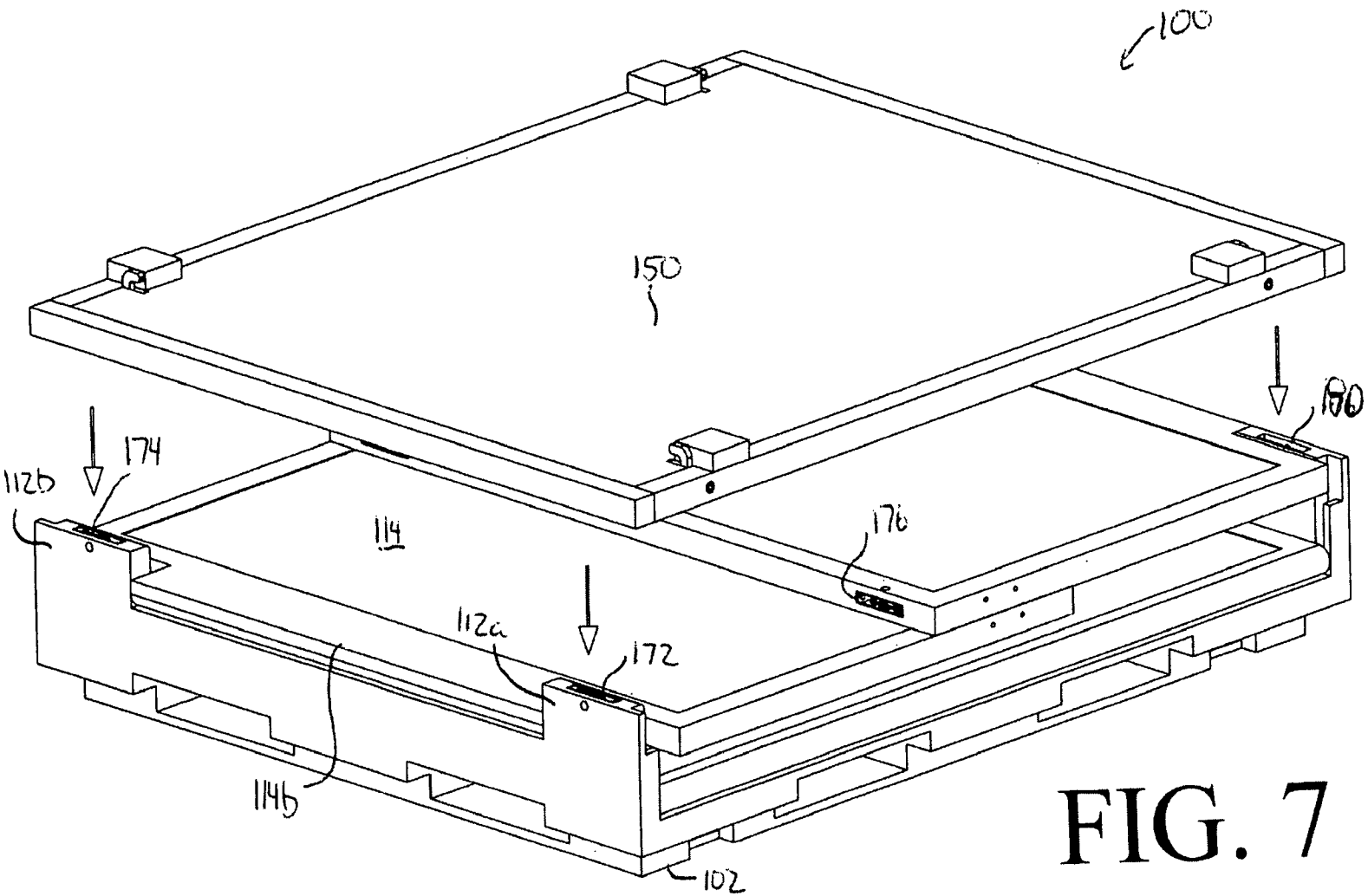
FIG. 7 is a perspective view of the collapsible container of FIGS. 1 through 6, depicting the container in a collapsed position with the top cover separated apart and positioned for engagement with the remainder of the collapsed container.
Figure 8:
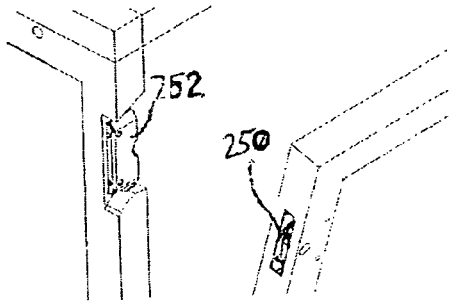
FIG. 8 is an enlarged, perspective view of a latch unit and mating receptacle located on the front panel and a side panel, respectively, of the container of FIGS. 1 through 7.
Figure 9:
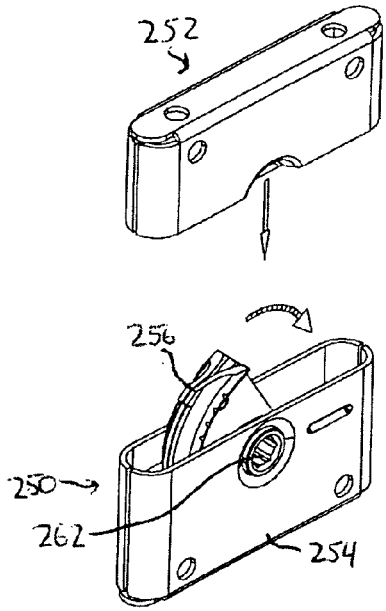
FIG. 9 is a perspective view of a latching mechanism, depicting latching and receptacle units of the latching mechanism separated apart from one another.
Figure 10:
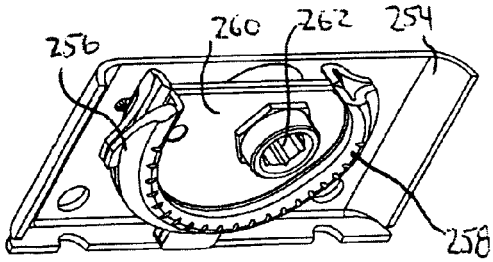
FIG. 10 is a perspective, cut away view of the latching unit of FIG. 9, depicting a cam of the latching unit in an unlatched state.
Figure 11:
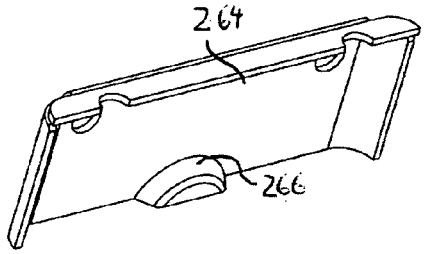
FIG. 11 is a perspective, cut away view of the receptacle unit of FIG. 9.

Turning to FIG. 7, in the collapsed position the top cover 150 is seatable on top of the flange portions 112*a*, 112*b*, 122*a*, and 122*b*. In the illustrated embodiment, the side panels 114 and 124 and front and rear panels 130 and 140 are interposed between the top cover 150 and the base 102. The top cover 150 may then be locked to the base 102 for storage by engaging latches in the base with latching receptacles in the cover 150. Specifically, the latch units of the ninth, tenth, thirteen, and fourteenth latching mechanisms engage the latch receptacles of seventh, eighth, eleventh, and twelfth latching members, respectively.

Figure 12:
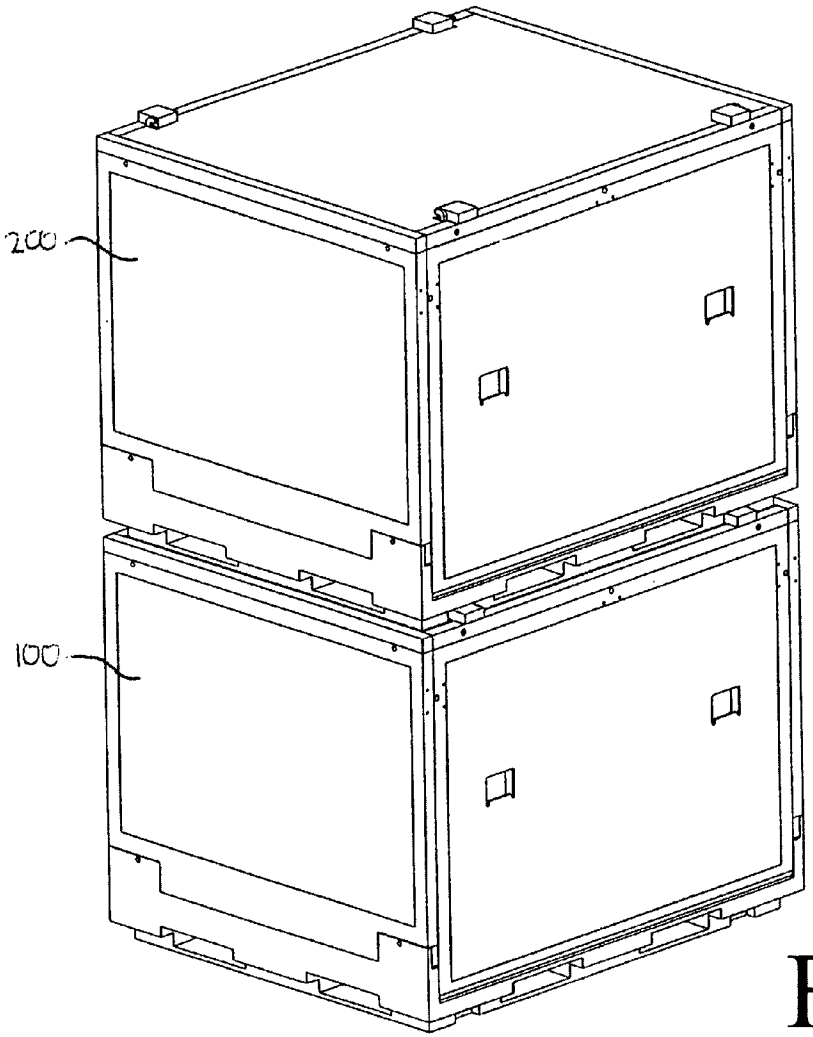
FIG. 12 is a perspective view of first and second erect containers stacked one upon the other.
Figure 13:
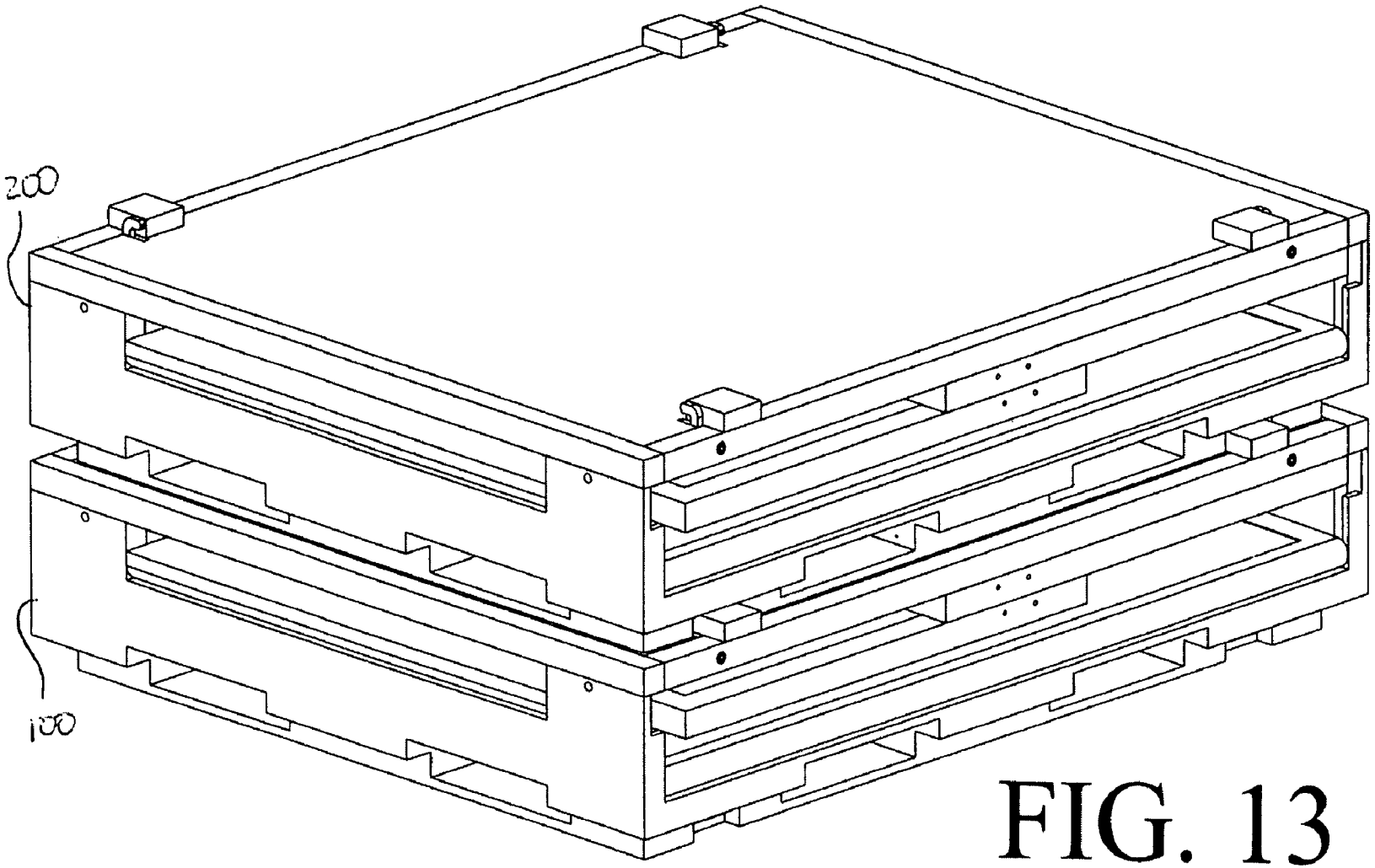
FIG. 13 is a perspective view of the first and second containers of FIG. 12 shown in collapsed positions and stacked one upon the other.

According to an optional embodiment, the containers are stackable upon one another in both the erect and collapsed positions. FIGS. 12 and 13 illustrate a second container 200 stacked upon the above-described container 100 (also referred to herein as the first container 100) in the erect and collapsed positions, respectively. The stacked containers 100 and 200 may be locked in the stacked arrangement using locking mechanisms 184. As shown in FIG. 14, the locking mechanism 184 comprises elongated shaft 186 incorporated into and extending across the depth of the top cover 140. Preferably, two locking mechanisms 184 are provided, one each on opposite sides of the top cover 140. A central region of the shaft 186 comprises a journal portion supported by a shaft coupling or bearing 188. The opposite end portions of the shaft 186 comprise threads 190 and 191, respectively. Threads 190 have an opposite pitch to threads 191 for reasons that will become apparent below. The opposite ends of the shaft 186 terminate at drives 192 and 193, respectively, which are accessible from the front and rear faces of the container. Locking members 194 and 195 are threadedly engaged with and ride on the shaft threads 190 and 191, respectively.

The second container 200 comprises a support base 202 having slots 203 and 205. The locking members 194 and 195 are received in the slots 203 and 205, respectively, when the second container 200 is seated on top of the first container 100. By rotating the drive 192 counterclockwise (or by rotating the drive 193 clockwise), the locking members 194 and 195 simultaneously slide towards one another riding along threads 190 and 191, respectively, until the locking members 194 and 195 are received in slots 203 and 205, respectively. The containers 100 and 200 are thereby locked to one another. The locking engagement is reversible, i.e., by rotating the drive 192 clockwise (or by rotating the drive 193 counterclockwise).

The container may be made of a wide variety of materials, including wood, plastics, composites, metals and metal alloys. One currently contemplated material comprises extruded aluminum. Latch-receiving recesses and the like may be formed in the panels using conventional techniques, including machining and molding, and will largely depend upon the material from which the container is made.

One of the benefits of embodiments of the invention is that the front panel is removable to provide front access to the container compartment without requiring that the top cover be removed or partially opened. Another benefit of embodiments of the invention is that the latches for removing the front panel (and the rear panel) are accessible from below the top cover, i.e., at the end or side panels. Yet another benefit of embodiments of the invention is that a common tool, e.g., hex wrench, may be used to lock and unlock the latches.

The container may be used for shipping, storage, or a combination of shipping and storage. For example, a business or person needing to ship or store goods may arrange the container in an erect position, and load and unload goods into the container compartment through the top and/or front access opening(s). When the container is full or otherwise loaded with goods to be shipped, the container may be latched and placed onto a suitable transport vehicle (e.g., a truck or plane) and transported to its destination. Alternatively, if the container is no longer needed by the business or is to be returned to the business after shipment to its intended destination, the container may be collapsed for storage and shipment.

The container of this invention is suitable for different uses and may be used in various industries and with various transport vehicles. For example, the container may be especially useful for the shipment of explosives and weaponry for military uses. The container may also be useful in good shipping and storage applications for personal, military, commercial, and business needs.

Additional advantages and modifications will readily occur to those skilled in the art. Therefore, the invention in its broader aspects is not limited to the specific details, representative devices and methods, and illustrative examples shown and described. Accordingly, departures may be made from such details without departing from the spirit or scope of the general inventive concept as defined by the appended claims and their equivalents.

What is claimed is:

1. A container including a container compartment, comprising:

a support base;

first and second side structures each respectively comprising a respective side structure upper edge, the first and second side structures further respectively comprising first and second front guide tracks facing one another;

a rear panel comprising a rear panel upper edge and engaged with the first and second side structures;

a front panel comprising a front panel upper edge and first and second front track followers received in the first and second front guide tracks, respectively; and a top cover engageable with at least one of the front panel, the rear panel, and the first and second side structures, and movable between a closed state and an open state, in which the container compartment is accessible from above, wherein the front panel pivots outwardly away from the container compartment about the front track followers, while the first and second front track followers are engaged in the respective first and second front guide tracks and the top cover is in the closed state, and wherein the first and second front track followers are slidable along the respective first and second front guide tracks to permit front access to the container compartment.

2. The container according to claim 1, wherein the first and second front track followers are releasably received in the first and second front guide tracks, respectively for detaching the front panel.

3. The container according to claim 1, wherein the support base comprises a pallet.

4. The container according to claim 3, wherein the pallet comprises four-way entry pockets.

5. The container according to claim 1, wherein the first and second front guide tracks comprise respective substantially vertical channels and associated substantially horizontal channels.

6. The container according to claim 5, wherein the first and second side structures respectively comprising first and second side panels, said first and second side panels respectively comprise first and second forward edges, and wherein the substantially horizontal channels terminate at the first and second forward edges, respectively, for permitting the first and second front track followers to detachably engage and disengage the first and second front guide tracks.

7. The container according to claim 1, wherein the first and second front track followers project laterally from opposite sides of the front panel, respectively.

8. The container according to claim 1, wherein the first and second side structures comprise respective rear guide tracks facing one another, wherein the rear panel comprises rear track followers projecting laterally from opposite sides of the rear panel, the rear track followers are releasably received in the rear guide tracks of the first and second side structures, respectively, wherein the rear panel pivots outwardly away from the container compartment about the rear track followers, while the rear track followers are engaged in the respective rear guide tracks, from a substantially vertical orientation to an angled orientation in which the rear panel upper edge is exposed from under the cover, and wherein the rear track followers are slidable along and out of engagement with the respective rear guide tracks, while the rear panel is in the angled orientation and while the cover is in the closed state, to permit detachment of the rear panel for providing rear access to the container compartment.

9. The container according to claim 1, wherein the cover in the closed state prevents upward movement of the front panel when the front panel is in the substantially vertical state.

10. A collapsible container, including a container compartment, movable between an erect position and a collapsed position, comprising:

a support base;

first and second side structures each respectively comprising a respective side structure upper edge and each being movable between the erect position, in which the first and second side structures are spaced apart and substantially parallel to one another, and the collapsed position, in which the first and second side structures are stowed on the support base, wherein the first and second side structures respectively comprise first and second front guide tracks facing one another;

a rear panel comprising a rear panel upper edge and movable between the erect position and the collapsed position, in which the rear panel is stowable on the support base;

a front panel comprising a front panel upper edge and first and second front track followers releasably received in the first and second front guide tracks, respectively, the front panel being movable between the erect position, and the collapsed position, in which the front panel is stowable on the support base; and a top cover engageable with at least one of the front panel, rear panel, and the first and second side structures, and movable between a closed state and an open state, in which the container compartment is accessible from above, wherein the front panel pivots outwardly away from the container compartment about the first and second front track followers, while the top cover is in the closed state, and wherein the first and second front track followers are slidable along and out of engagement with the respective first and second front guide tracks, while the cover is in the closed state to permit detachment of the front panel for providing front access to the container compartment.

11. The collapsible container according to claim 10, wherein the support base comprises a pallet.

12. The collapsible container according to claim 11, wherein the pallet comprises four-way entry pockets.

13. The collapsible container according to claim 10, wherein the first and second side structures comprise first and second side panels, respectively, and wherein the first and second side structures further comprise opposed first and second side skirts, respectively, the first and second side skirts upwardly projecting from opposite sides of the support base and supporting the first and second side panels, respectively, when the container is in the erect position.

14. The collapsible container according to claim 13, wherein the first and second side panels are pivotally connected to the first and second side skirts, respectively, to permit pivotal movement of the first and second side panels between the erect and collapsed positions.

15. The collapsible container according to claim 13, wherein the first and second front guide tracks are formed in the first and second side skirts, respectively.

16. The collapsible container according to claim 10, wherein the first and second front guide tracks comprise respective substantially vertical channels and associated substantially horizontal channels.

17. The collapsible container according to claim 16, wherein the first and second side skirts comprise first and second forward edges, respectively, and wherein the substantially horizontal channels terminate at the first and second forward edges, respectively, for permitting the first and second front track followers detachably engage and disengage the first and second front guide tracks.

18. The collapsible container according to claim 10, wherein the first and second front track followers project laterally from opposite sides of the front panel, respectively.

19. The collapsible container according to claim 10, wherein the first and second side structures comprise respective rear guide tracks facing one another, wherein the rear panel comprises rear track followers project laterally, from opposite sides of the rear panel, the rear track followers are releasably received in the rear guide tracks of the first and second side structures, respectively, wherein the rear panel pivots outwardly away from the container compartment about the rear track followers, while the rear track followers are engaged in the respective rear guide tracks, from a substantially vertical orientation to an angled orientation in which the rear panel upper edge is exposed from under the cover, and wherein the rear track followers are slidable along and out of engagement with the respective rear guide tracks, while the rear panel is in the angled orientation and while the cover is in the closed state, to permit detachment of the rear panel for providing rear access to the container compartment.

20. The collapsible container according to claim 10, wherein the cover in the closed state prevents upward movement of the front panel when the front panel is in a substantially vertical state.

21. The collapsible container according to claim 10, further comprising a plurality of latching mechanisms for selectively latching and unlatching the top cover to the front panel and the side panel, each of the plurality of latching mechanisms is accessible and selectively actuatable below the top cover.

* * * * *